United States Patent [19]

Kandatsu

[11] Patent Number: 4,853,662

[45] Date of Patent: Aug. 1, 1989

[54] CONTACTOR APPARATUS

[75] Inventor: Kiyoshi Kandatsu, Kanagawa, Japan

[73] Assignee: Fuji Electric Co., Ltd., Kanagawa, Japan

[21] Appl. No.: 113,521

[22] Filed: Oct. 28, 1987

[30] Foreign Application Priority Data

Oct. 29, 1986 [JP] Japan ..... 61-257520

[51] Int. Cl.[4] ..... H01H 3/00

[52] U.S. Cl. ..... 335/185; 335/16

[58] Field of Search ..... 335/16, 195, 147, 190, 335/185, 189, 6, 15; 200/238, 244

[56] References Cited

U.S. PATENT DOCUMENTS 4,346,357 8/1982 Kussy et al. ..... 335/195

4,635,012 1/1987 Kohanawa et al. ..... 335/16

*Primary Examiner*—E. A. Goldberg

*Assistant Examiner*—Lincoln Donovan

*Attorney, Agent, or Firm*—Finnegan, Henderson, Farabow, Garrett and Dunner

[57] ABSTRACT

A limiting-current type contactor apparatus for providing stable current-limiting breaking properties with less reduction of the breaking speed due to magnetic repulsion force is provided with a movable contactor arm supported by a contactor support fixed to a switching shaft and a fixed contactor. The fixed contactor has a first conductor portion and a shaft for pivotally mounting the movable contactor. The movable contactor has a second conductor portion spaced opposite and apart from the first conductor portion, thereby forming an arcuate gap of uniform and small width between the first and second conductor portions and concentric with the shaft. A flexible conductor is connected between the first and second conductor portions for reversing the direction of current flow between first conductor portion and the movable contactor arm.

5 Claims, 1 Drawing Sheet

CONTACTOR APPARATUS

BACKGROUND OF THE INVENTION

The present invention relates to current-limiting contactor apparatus primarily used in a circuit breaker.

A conventional current-limiting type of contactor apparatus is shown in FIG. 3 by way of example. In the drawing, a movable contactor 3 is pivotally supported at a shaft 4 by a contactor support 2 fixed to a switching shaft 1 and a movable contact 5 is integrally provided at an end portion of the movable contactor 3. The movable contactor 3 is bent in a U-shape and disposed so as to be able to detachably contact with a fixed contact 7 of a fixed contactor 6 which is arranged so that the direction of the current flowing in the fixed contactor 6 is opposite to that of the current flowing in the movable contactor 3. The movable contactor 3 is urged against the fixed contactor 6 by a helical torsion spring 8 mounted on the shaft 4. The magnetic repulsion force F between the contactors 3 and 6 is represented generally by the expression $F \propto (L/S)I^2$, where L is the length between the contactors 3 and 6, S is the distance of separation between the movable and fixed contactors 3 and 6, and I is the currentflowing through contactors 3 and 6. Accordingly, in the thus arranged contactor apparatus, as the distance S between the opposed movable and fixed contactors 3 and 6 is made smaller (i.e., to S1 in FIG. 3), and as the length L between the contactors 3 and 6 and the current I flowing through the contactors 3 and 6 are both made larger, the magnetic repulsion force F acting between the contactors 3 and 6 becomes larger.

However, there are disadvantages in the conventional contactor apparatus in that when the movable contactor 3 is separated from the fixed contactor 6, the opposing distance S1 in the initial stage becomes larger as the separation progresses(i.e., to S2 in FIG. 3), so that the magnetic force decreases in proportion to the increase of the opposing distance S1 to lower the breaking speed to thereby lower the current limiting breaking performance. If the opposing length L is made longer as means to compensate the above-mentioned disadvantage, the contactor apparatus per se becomes large in size.

SUMMARY OF THE INVENTION

It is therefore an object of the present invention to eliminate the above mentioned disadvantages in the prior art.

It is another object of the present invention to provide a contactor apparatus in which, without making the contactor apparatus large-sized, the breaking speed of a movable contactor can be maintained in the initial state and the current limiting breaking effect can be improved.

In order to attain the above objects, and in accordance with the present invention as embodied and broadly described herein, a contactor apparatus is provided comprising a contactor support having a first conductor portion and a switching shaft; a movable contactor arm having a contact portion and a second conductor portion mounted on the switching shaft to pivot between open and closed positions; a fixed contact disposed to be engaged by the contact portion of the movable contactor arm in the closed position and separated from the contact portion in the closed position; opposing convex or concave surfaces on the first and second conductor portions which are movable relative to one another and spaced from each other during pivoting of the contactor arm between open and closed positions; a means for connecting the first conductor portion to a voltage source; and a flexible conductor connecting the first conductor portion adjacent the end opposite the connecting means to the second conductor portion adjacent the opposite end of the first conductor portion for reversing the direction of current flow between the first conductor portion and the connector arm.

In operation, the arcuate gap of constant width separating the convex conductor and the concave contactor is maintained constant and small, thereby suppressing during the breaking operation the decrease of the magnetic repulsion and minimizing the lowering of the breaking speed to thereby improve the currentlimiting breaking performance.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate a preferred embodiment of the invention and, together with the summary description given above and the detailed description of the preferred embodiment including the appended claims given below, serve to explain the principles of the invention.

DESCRIPTION OF THE PREFERRED EMBODIMENT

Reference will now be made in detail to the present preferred embodiment of the invention as illustrated in the accompanying drawings.

Figure 1:
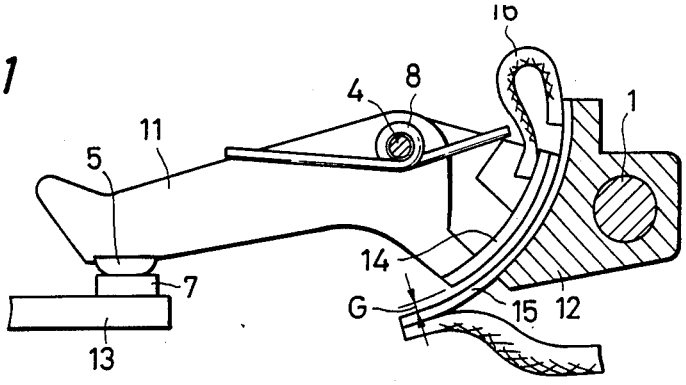
FIG. 1 is a side view partly in section showing the preferred embodiment of the contactor apparatus according to the present invention in the on-state thereof.
Figure 2:
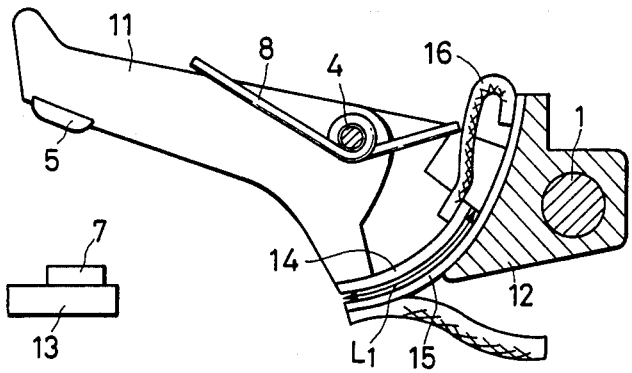
FIG. 2 is a similar side view partly in section showing the same contactor apparatus of FIG. 1 in the off-state.
Figure 3:
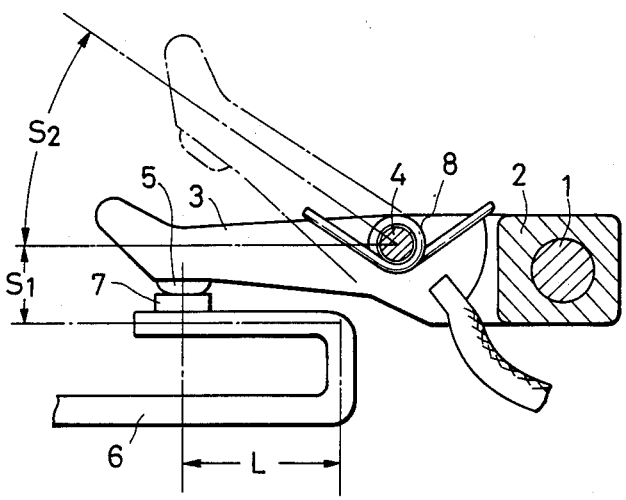
FIG. 3 PRIOR ART
FIG. 3 is a side view partly in section showing a conventional contactor apparatus in the on-state, with the off-state also shown in phantom.

FIGS. 1 and 2 (wherein like numerals refer to like parts) show the preferred embodiment of the contactor apparatus according to the present invention, in which FIG. 1 is a side view partly in section showing the contactor apparatus in the on-state and FIG. 2 is a side view partly in section showing the contactor apparatus in the off-state for explaining the breaking operation of a contactor apparatus. In the drawings, items the same as or equivalent to those of the conventional contactor apparatus in FIG. 3 are referenced correspondingly. The contactor apparatus of this embodiment is different from the conventional one in that in a former function for generating the magnetic repulsion force between movable and fixed contactors 11 and 13 is provided between the movable contactor or arm 11 and a contactor support 12 and the function is made stronger so that the magnetic repulsion force does not vary even if the separation between the movable and fixed contactors 11 and 13 increases. To this end, the fixed contactor 13 has a shape like a belt and is integrally provided with a fixed contact 7 at its end. The movable contactor 11 is fixedly provided at its one end with a movable contact 5 for performing make-and-break operation with the fixed contact 7, and the movable contactor 11 is further integrally provided with a convex conductor 14 at a lower portion of its other end which is opposite to the one end with respect to a shaft 4 at which the movable contactor 11 is supported by the contactor support 12, the convex conductor 14 being concentric with the shaft 4. On the other hand, a concave conductor 15 is provided integrally on the contactor support 12 and concentrically with the shaft 4 so as to be in opposition to the convex conductor 14 with a fine gap G therebetween and so as to cover the entire range of rotation of the convex conductor 14, and the convex conductor 14 and the concave conductor 15 are connected by a flexible conductor 16 so that the current flowing through the convex and concave conductors 14 and 16 is reversed in direction between the convex conductor 14 and the concave conductor 15. The convex conductor 14 and the concave conductor 15 are arranged so that the gap G can be set to a desired value so as to be able to cope with a small current range.

In such an arrangement, even when the movable contactor 11 is separated from the fixed contactor 13 so that the opposing distance between the movable contactor 11 and 13 is increased to S2 as shown in FIG. 3, the gap G and the opposing length L1 between the convex conductor 14 and the concave conductor 15 does not vary. Further, although the acting point of the magnetic repulsion force is displaced to a lower point as the separating operation of the movable contactor 11 progresses so that the force of the helical torsion spring 8 becomes larger, the breaking speed remains substantially the same. Accordingly, the current limiting breaking can be performed efficiently.

According to the present invention, it is possible to provide a contactor apparatus in which a constant arcuate gap is provided between a movable contactor and a contactor support as a function for generating a magnetic repulsion force acting on the movable contactor in a breaking operation to thereby suppress the reduction of the magnetic repulsion force so that the contactor apparatus is provided with a stable current limiting breaking property with less reduction of the breaking speed.

It will be apparent to those skilled in the art that various modifications, variations and additions can be made in the present invention without departing from the spirit or scope of the present invention. Thus, it is intended that the present invention cover the modifications and variations provided they come within the general scope of the claims and their equivalents.

What is claimed is:

1. A contactor apparatus, comprising:

a contactor support having a first conductor portion;

a movable contactor arm, having a contact portion and a second conductor portion pivotably mounted on said support to pivot between an open and closed position;

a fixed contact disposed to be engaged by said contact portion of said movable contactor arm in the closed position and separated from said contact portion in the open position;

said first and second conductor portions having opposing respective convex or concave surfaces, said surfaces being movable relative to one another and spaced from each other during pivoting of said contactor arm between said open or closed position;

means for connecting said first conductor portion adjacent one end thereof to a voltage source; and a flexible conductor connecting said first conductor portion adjacent the end opposite the connecting means to the second conductor portion adjacent said opposite ends of the first conductor portion for reversing the direction of current flow between the first conductor portion and the movable contactor arm.

2. A contactor apparatus as recited in claim 1, further comprising a shaft on said contactor support for pivotably supporting said contactor arm and a helical torsion spring mounted on said shaft for urging the movable contactor arm in engagement with the fixed contact.

3. A contactor apparatus as recited in claim 2, wherein the first conductor portion is concave and the second conductor portion is convex, said concave and convex portions being spaced apart to form an arcuate gap of predetermined and constant width, said arcuate gap being concentric with the shaft about which the movable contactor is pivotally mounted.

4. A contactor apparatus as recited in claim 1, wherein the first conductor portion is convex and the second conductor portions is concave.

5. A contactor apparatus comprising:

a contactor support having a first conductor portion;

a movable contactor arm, having a contact portion and a second conductor portion pivotably mounted on said support to pivot between an open and closed position;

a fixed contact disposed to be engaged by said contact portion of said movable contactor arm in the closed position and separated from said contact portion in the open position;

a shaft on said contactor support for pivotably supporting said contactor arm and a helical torsion spring mounted on said shaft for urging the movable contactor arm in engagement with the fixed contact;

said first and second conductor portions having opposing respective convex or concave surfaces, said concave and convex surfaces being movable relative to one another and spaced apart from each other during pivoting of said contactor arm between said open or closed position;

said concave and convex portions being spaced apart to form an arcuate gap of predetermined and constant width, said arcuate gap being concentric with the shaft about which the movable contactor is pivotably mounted;

means for connecting said first conductor portion adjacent one end thereof to a voltage source; and a flexible conductor connecting said first conductor portion adjacent the end opposite the connecting means to the second conductor portion adjacent said opposite ends of the first conductor portion for reversing the direction of current flow between the first conductor portion and the movable contact arm.

* * * * *